US006170125B1

(12) United States Patent
Steinert et al.

(10) Patent No.: US 6,170,125 B1
(45) Date of Patent: Jan. 9, 2001

(54) APPARATUS FOR FEEDING SLIVERS TO A DRAW FRAME

(75) Inventors: Thomas Steinert, Kempen; Josef Temburg, Jüchen, both of (DE)

(73) Assignee: Trützschler GmbH & Co. KG, Mönchengladbach (DE)

( * ) Notice: Under 35 U.S.C. 154(b), the term of this patent shall be extended for 0 days.

(21) Appl. No.: 09/263,505

(22) Filed: Mar. 8, 1999

(30) Foreign Application Priority Data

Mar. 7, 1998 (DE) ..... 198 09 875

(51) Int. Cl.[7] ..... D01H 5/00

(52) U.S. Cl. ..... 19/236; 19/65 A; 19/150; 226/188; 492/10; 492/16

(58) Field of Search ..... 19/236, 237, 235, 19/239, 240, 238, 150, 157, 258, 260, 293, 65 A, 159 R; 57/281, 315; 492/10, 16; 226/188, 190

(56) References Cited

U.S. PATENT DOCUMENTS

| | | | | |
|---|---|---|---|---|
| 4,473,924 | * | 10/1984 | Hartmannsgruber et al. | 19/239 |
| 5,161,284 | * | 11/1992 | Leifeld | 19/260 |
| 5,226,212 | * | 7/1993 | Beringer | 19/65 A |
| 5,412,301 | * | 5/1995 | Jornot et al. | 19/239 |
| 5,524,805 | * | 6/1996 | Shiba et al. | 226/188 |
| 5,687,454 | * | 11/1997 | Langen | 57/281 |
| 5,762,973 | * | 6/1998 | Holzschuh | 425/145 |
| 5,852,844 | * | 12/1998 | Leifeld | 19/236 |

FOREIGN PATENT DOCUMENTS

| | | |
|---|---|---|
| 851 010 | 9/1952 | (DE) . |
| 1115624 | 10/1961 | (DE) . |
| 31 40 423 | 4/1983 | (DE) . |
| 42 16 299 | 11/1991 | (DE) . |
| 44 04 326 | 10/1994 | (DE) . |
| 44 24 490 | 1/1996 | (DE) . |
| 195 37 983 | 4/1997 | (DE) . |
| 0 367 211 | 5/1990 | (EP) . |
| 1 372 513 | 10/1974 | (GB) . |
| 2 273 508 | 6/1994 | (GB) . |

* cited by examiner

*Primary Examiner*—John J. Calvert
*Assistant Examiner*—Gary L. Welch
(74) *Attorney, Agent, or Firm*—Gabor J. Kelemen; Venable

(57) ABSTRACT

A sliver supplying apparatus for simultaneously feeding a plurality of slivers to a draw frame includes an intake table; a plurality of supply rolls supported in a series by the intake table for guiding the slivers from the coiler cans to the draw frame; and an rpm-setting device for individually setting a circumferential speed of the supply rolls. The rpm-setting device includes a roll drive independent from the drive of the draw frame.

13 Claims, 5 Drawing Sheets

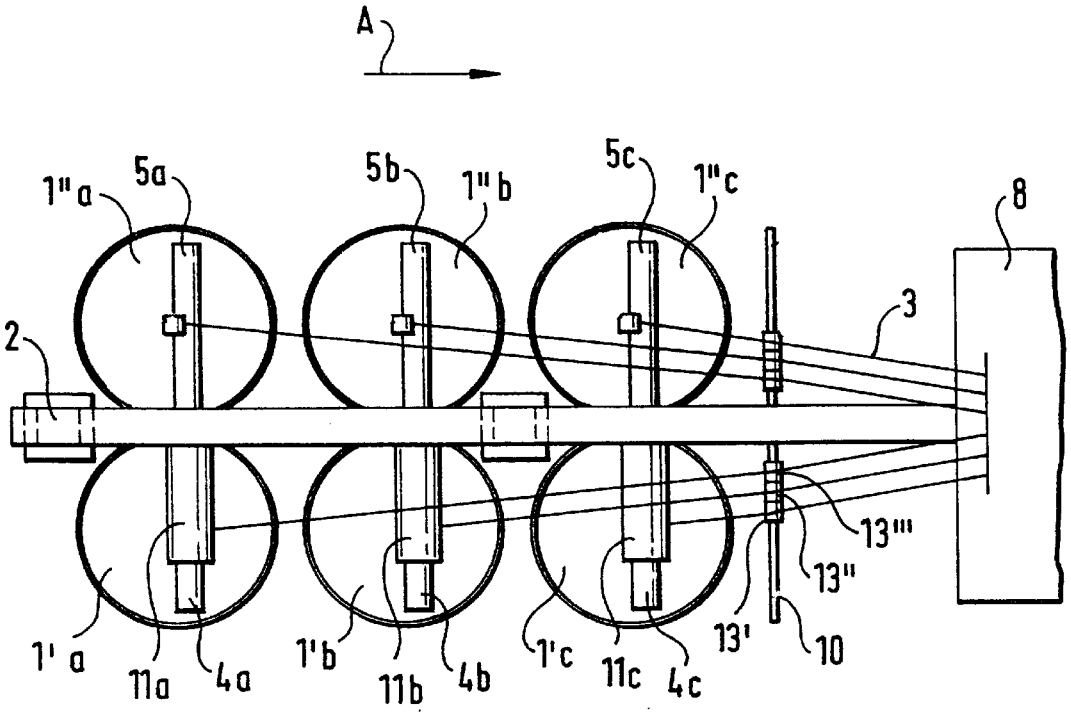
FIG. 2
FIG. 3
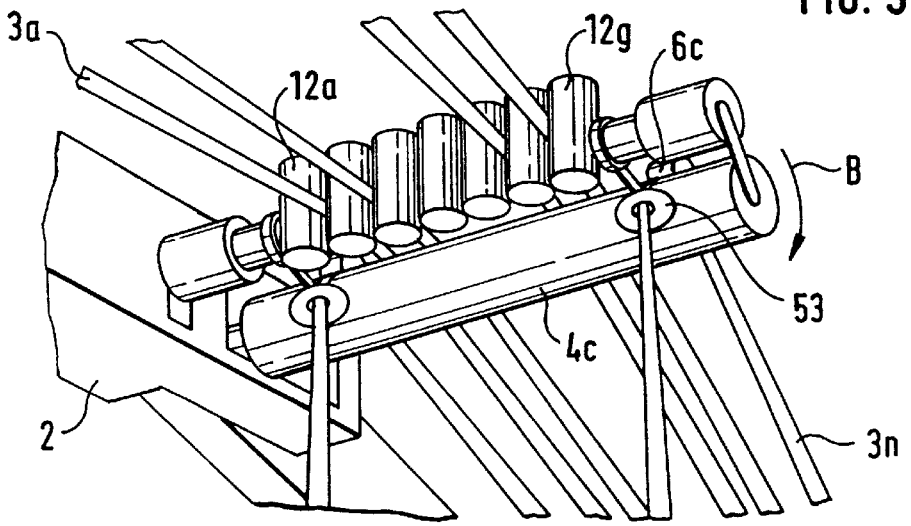

FIG. 4a
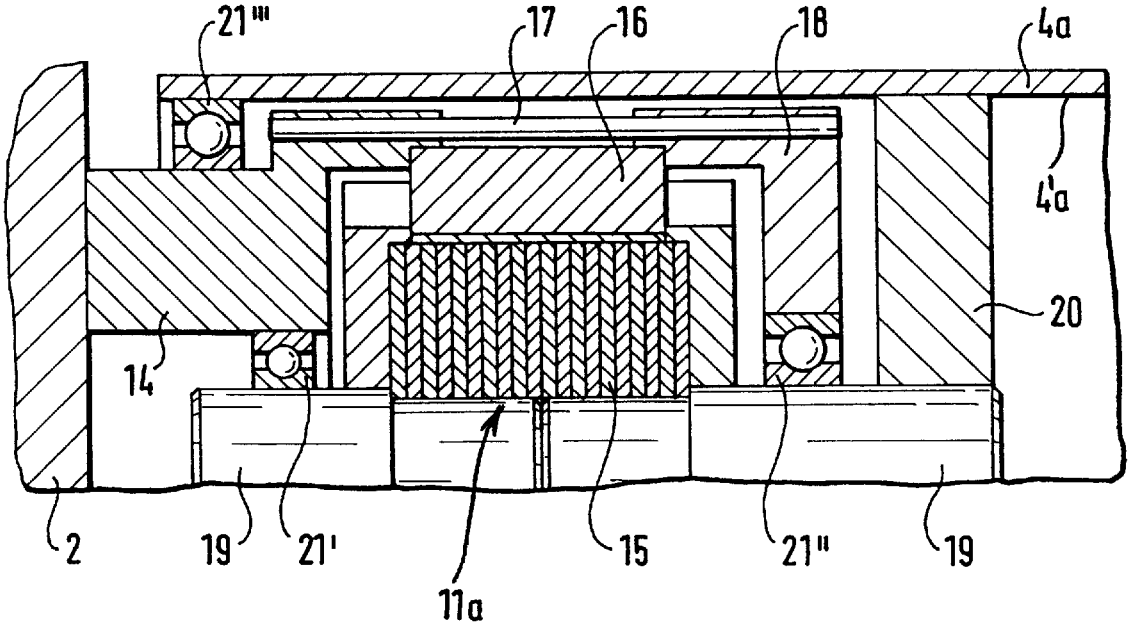
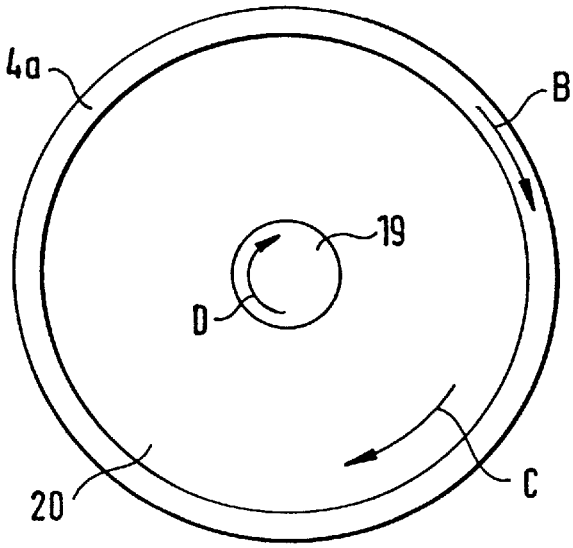
FIG. 4b

FIG. 5
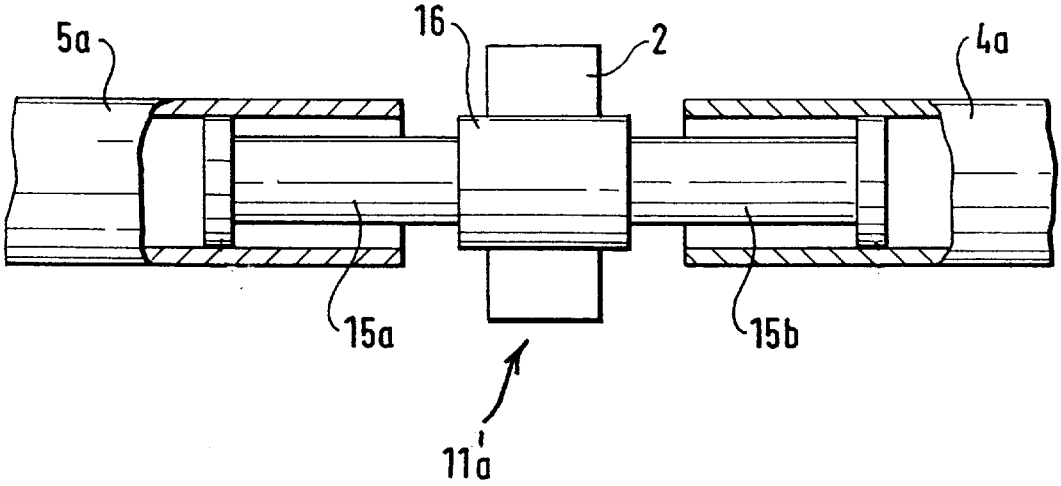
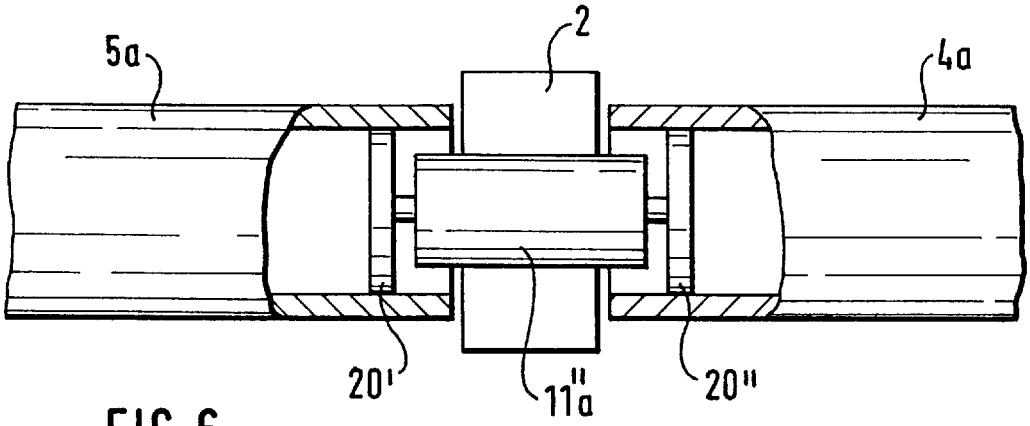
FIG. 6
FIG. 7
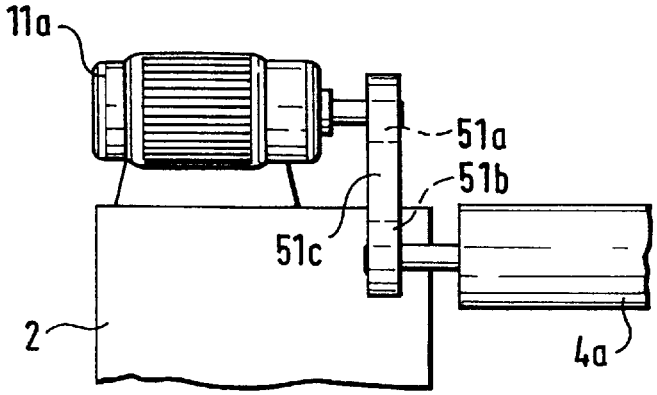

APPARATUS FOR FEEDING SLIVERS TO A DRAW FRAME

CROSS REFERENCE TO RELATED APPLICATION

This application claims the priority of German Application No. 198 09 875.8 filed Mar. 7, 1998, which is incorporated herein by reference.

BACKGROUND OF THE INVENTION

This invention relates to an apparatus for feeding slivers to a drawing unit of a fiber processing machine, particularly a draw frame in which the slivers are pulled from coiler cans by a withdrawing roll pair after they run through a plurality of supply rolls which are mounted on a sliver intake table and which have different circumferential speeds.

The slivers which are, by means of the roll pairs (supply roll and pressure roll) of the intake table, guided to a sliver drawing unit, enter the nip of the withdrawing roll pair in a state stretched about 1.05 times after they run on rider rolls. The intake draft equals the ratio of the circumferential speed of the rider rolls to that of the withdrawing rolls. In practice, the intake draft is set such that each sliver runs between the intake rolls and the rider rolls at the smallest possible tension, but without any snag.

In conventional arrangements the supply rolls have been driven, via transmission mechanisms (belts, sprockets, and the like) by the drive of the draw frame, that is, the motor which forms part of the drive for the drawing unit. In such arrangements the supply rolls have, as a rule, identical circumferential speeds. The slivers may often run at unlike tensions, for example, because of different distances between the supply rolls, on the one hand, and the intake roll pair, on the other hand. Since, however, the slivers which are only slightly twisted, are composed of loosely interconnected fibers, they are coherent only by virtue of the friction between the fibers and are not able to take up any mechanical tension stress without undergoing, at the stressed locations, an undesired elongation which may adversely affect successive processing steps.

It is a further disadvantage of the above-outlined prior art arrangement that while all the coiler cans at the intake table initially contain sliver quantities of equal length, often residual sliver quantities remain in some of the coiler cans, while others have already been emptied. In their travel path from the coiler can to the intake of the draw frame the slivers have to change direction several times. Since the locations of reorientation involve friction, forces are generated during the sliver travel which lead to unintended drafts as a function of the properties of the material and the free path lengths of the sliver between the coiler can and the machine. Such parasite drafts have a stationary and a non-stationary draft component. The stationary draft component leads to the above-noted non-simultaneous emptying of the coiler cans since the fiber processing machine pulls the slivers with a constant sliver speed rather than with a constant mass flow. The non-stationary component which is generated by the own dynamic properties of the sliver during the withdrawal process, leads to fluctuations in the number of the inputted sliver.

German Auslegeschrift (application published after examination) 1,115,624 discloses an arrangement in which the supply rolls, dependent on their distance from the drawing unit, have different diameters and, accordingly, different circumferential speeds. The different circumferential speeds decrease as the distance from the drawing unit increases so that a slippage between the slivers and the supply rolls as well as a sagging of the sliver between successive supply rolls is compensated for and thus the slivers, upon entry into the withdrawing roll pair of the drawing unit have, with a good approximation, identical tensions. In this arrangement the supply rolls which are closest to the drawing unit have—assuming an identical rpm for all supply rolls—larger diameters than the more remote supply rolls. All the supply rolls are driven by a common drive shaft. It is a disadvantage of such a prior art arrangement that an adaptation of the intake tension between successive supply rolls is not possible as the operational conditions change. It is a further drawback that the slivers have only approximately the same tension.

SUMMARY OF THE INVENTION

It is an object of the invention to provide an improved apparatus of the above-outlined type from which the discussed disadvantages are eliminated and which, in particular, makes possible an adjustment of the intake tension of the slivers in case of changed operational conditions and further permits an evening of such intake tensions.

This object and others to become apparent as the specification progresses, are accomplished by the invention, according to which, briefly stated, the sliver supplying apparatus for simultaneously feeding a plurality of slivers to a draw frame includes an intake table; a plurality of supply rolls supported in a series by the intake table for guiding the slivers from the coiler cans to the draw frame; and an rpm-setting device for individually setting a circumferential speed of the supply rolls. The rpm-setting device includes a roll drive independent from the drive of the draw frame.

By virtue of the fact that for the supply rolls a driving assembly is provided which is independent from the driving assembly of the drawing unit and which, in particular, comprises individual, adjustable drives, the circumferential speed of at least one supply roll may be adjusted and adapted to the intake tension in a simple manner in case of changes in operational conditions. In this manner, an evening of the intake tension of the slivers among themselves is possible in a particularly advantageous manner. The apparatus according to the invention counteracts undesired tensions by suitably adapted rpm's (circumferential speeds) of the supply rolls. In particular, the undesired tension of all introduced slivers may be made identical, and thus, as a result, the coiler cans are all simultaneously emptied.

The invention has the following additional advantageous features:

- A separate, rpm-regulated electric motor, such as a servomotor is connected to each supply roll and is coupled with an electronic control and regulating device for setting predetermined rpm's.
- The servomotor is a d.c. motor or a frequency controlled three-phase squirrel cage motor.
- The rpm of the electric motor may be set in a stepless manner.
- The electronic control and regulating device has a desired rpm setter which is connected with memories and/or measuring elements.
- Data representing properties of fiber to be processed are applied to a memory.
- At least one measuring element measures the speed of the slivers.
- Between the drive motor and the supply roll a transmission element, such as a gearing is provided.

BRIEF DESCRIPTION OF THE DRAWINGS

FIG. 2 is a schematic top plan view of one part of the construction shown in FIG. 1.

FIG. 3 is a perspective view of one part of the structure of FIG. 2 as seen obliquely from below and illustrating the guidance of slivers over a supply roll.

FIG. 4*a* is an axial sectional view of one longitudinal half of a supply roll including an inner motor and structured according to a preferred embodiment of the invention.

FIG. 4*b* is a schematic end view of the structure shown in FIG. 4*a*.

FIG. 5 is a side elevational view of two coaxially arranged supply rolls having a sole inner motor provided with two rotors according to a further preferred embodiment of the invention.

FIG. 6 is a side elevational view showing two coaxially arranged supply rolls having a sole inner motor provided with one rotor, according to yet another preferred embodiment of the invention.

FIG. 7 is a schematic elevational view of an rpm-controlled individual drive motor, also showing a supply roll and a force-transmitting element.

DESCRIPTION OF THE PREFERRED EMBODIMENTS

Figure 1:
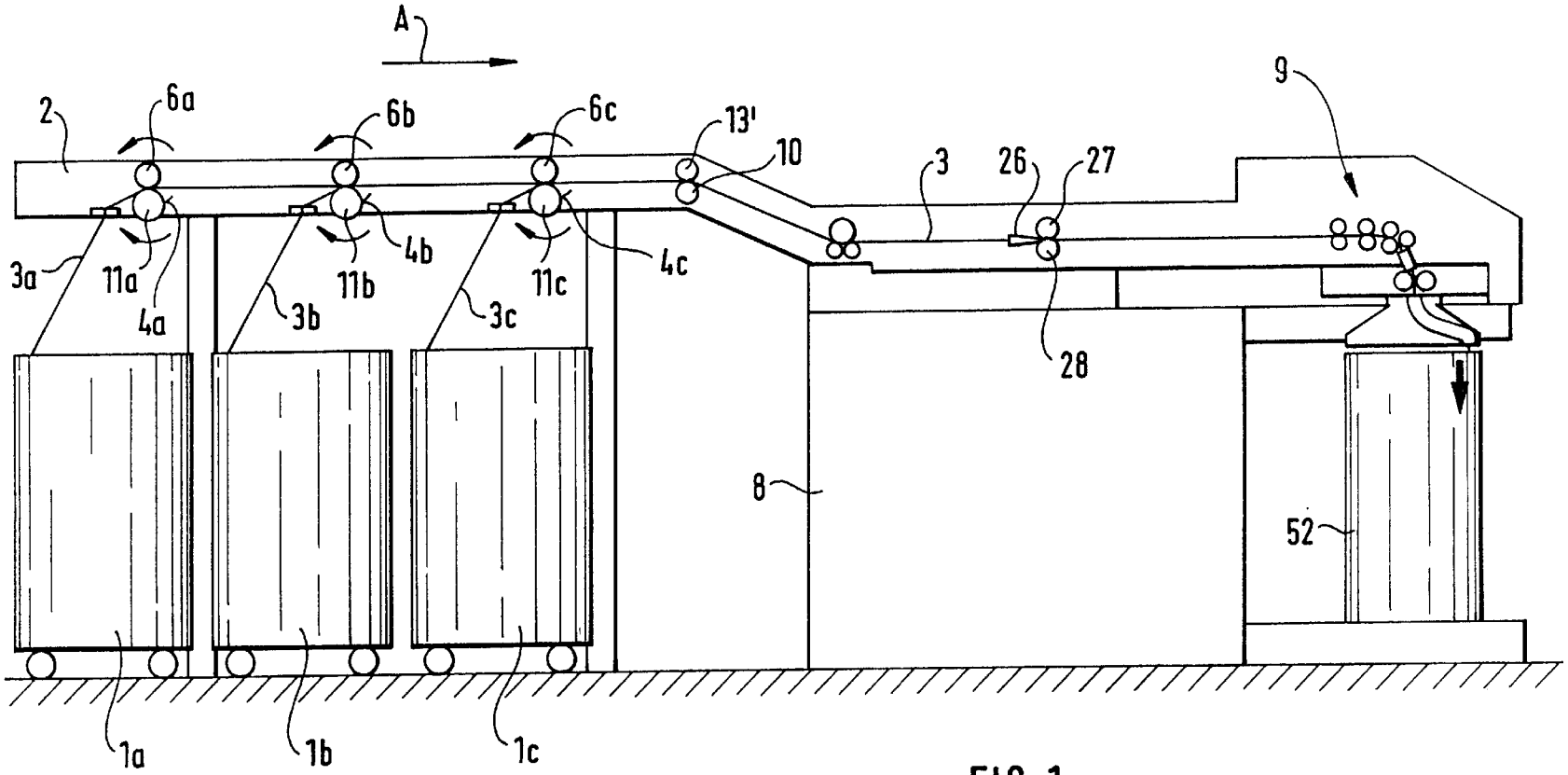
FIG. 1 is a schematic side elevational view of an intake table of a draw frame incorporating the invention.

Turning to FIG. 1, coiler cans 1*a,* 1*b* and 1*c* are situated underneath a sliver intake table 2 from which slivers 3*a,* 3*b* and 3*c* are pulled by supply rolls 4*a,* 4*b* and 4*c* and introduced into a draw frame 8 which has a drawing unit 9 and which may be, for example, an HS model, manufactured by Trützschler GmbH & Co. KG, Mönchengladbach, Germany. A respective upper idling roll 6*a,* 6*b,* 6*c* is associated with each supply roll 4*a,* 4*b,* 4*c* which are rotated by individual drive motors according to the invention, as will be discussed below.

FIG. 1 shows three supply roll pairs 4*a,* 6*a;* 4*b,* 6*b;* and 4*c,* 6*c*. The rolls 4*a,* 4*b* and 4*c* are driven supply rolls, whereas the rolls 6*a,* 6*b* and 6*c* are respective idling rolls. Slivers 3*a,* 3*b* and 3*c* are pulled from the coiler cans 1*a,* 1*b* and 1*c* and guided to the draw frame 8 on the intake table 2. After passing through the drawing unit, the drawn sliver is introduced into a rotary head of a sliver coiler and is deposited in coils into output coiler cans 52. The sliver intake table 2 extends up to the draw frame 8 over the region of the entire sliver intake device. In the region of the respective lower rolls 4*a–c* a guiding mechanism is provided for guiding the slivers 3*a–c* in upwardly open guide grooves, as shown in FIG. 3. The running direction of the slivers 3*a–c* is designated at A. The slivers 3*a–c* are pinched between the respective roll pairs. The slivers 3*a–c* taken from the respective coiler cans 1*a–c,* balloon above the coiler cans particularly at high withdrawing speed and are quieted as they continue their travel beyond the respective supply rolls 4*a–c*. The direction of rotation of the supply rolls 4*a–c* and the upper rolls 6*a–c* are indicated by curved arrows drawn into the respective rolls.

Turning to FIG. 2, a driven roll assembly, formed, for example, of a lower rider roll 10 and three upper rider rolls 13', 13", 13'" is positioned downstream of the intake,table 2 (as viewed in the feed direction A) at the intake of the draw frame 8. For each supply roll 4*a–c* a respective rpm-regulated drive motor (for example, a servomotor) 11*a,* 11*b* and 11*c* is provided.

Figure 8:
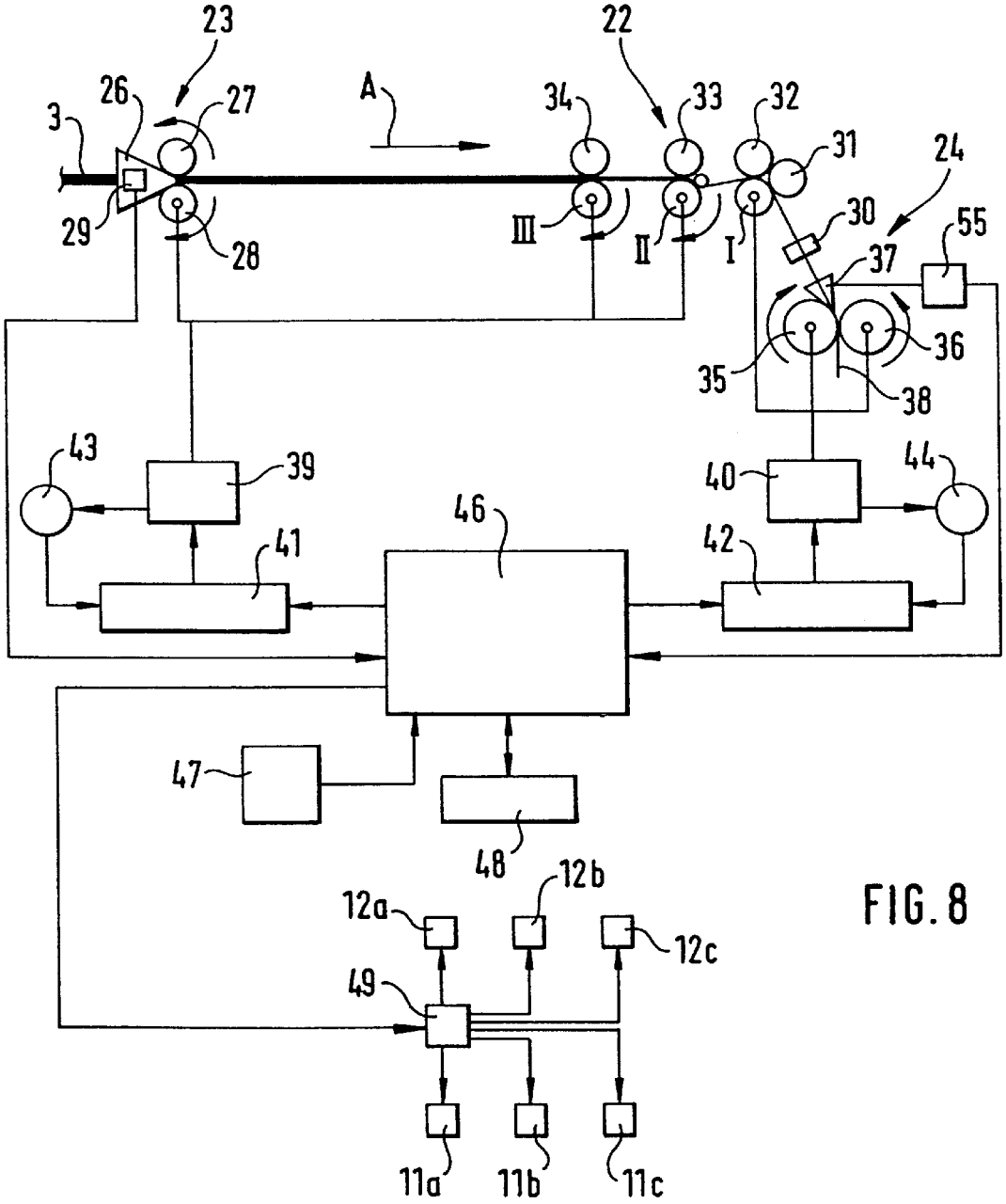
FIG. 8 is a schematic side elevational view, with block diagram, of a regulated draw frame, illustrating a block diagram of a control for the individual setting of the circumferential speed of the supply rolls provided on the sliver intake table of the draw frame.

In the example illustrated in FIG. 2, two parallel-extending coiler can rows are provided on emplacements situated below and on opposite sides of the intake table 2. In the illustrated example each can row is formed of three coiler cans 1'*a–c* and 1"*a–c,* respectively. During operation respective slivers 3 may be simultaneously withdrawn from the six coiler cans. It is feasible, however, to operate the apparatus in such a manner that slivers 3 are withdrawn simultaneously only from one side of the intake table 2, that is, only from three coiler cans forming one row, while on the respective other side the three coiler cans are being replaced (for example, full coiler cans are substituted for empty cans). Further, on opposite sides of the intake table 2 three supply rolls 4*a–c* and, respectively, three supply rolls 5*a–c* are provided. Each supply roll on one side of the intake table 2 is arranged coaxially with a respective supply roll on the other side of the intake table 2, whereby three supply roll pairs formed of supply rolls 4*a,* 5*a;* 4*b,* 5*b* and 4*c,* 5*c* are formed. The supply roll pairs 4*a*/5*a,* 4*b*/5*b* and 4*c*/5*c* are individually driven by respective rpm-controlled electric motors 11*a,* 11*b* and 11*c*. The electric motors 11*a–c* are connected, as shown in FIG. 8, to a common electronic control and regulating device 46, for example, a microcomputer. All the supply rolls have identical diameters, for example, 100 mm. The rpm's of the respective motors 11*a*–11*c* decrease in the sliver supply direction A (FIG. 2); thus $n_1>n_2>n_3$. The rpm's $n_1$, $n_2$ and $n_3$ are preset by the control and regulating device 46. For example, if $n_1=900$ $min^{-1}$, $n_2=850$ $min^{-1}$ and $n_3=800$ $min^{-1}$, the respective circumferential speeds are $U_1=282$ m/min, $U_2=267$ m/min and $U_3=251$ m/min. Thus, the circumferential speeds of the supply roll pairs 4*a,* 5*a;* 4*b,* 5*b* and 4*c,* 5*c* decrease in the sliver supply (sliver run) direction A. By virtue of providing individual motors 11*a–c,* an individual setting of the circumferential speeds $U_1$, $U_2$ and $U_3$ is feasible, so that the intake tension of all the slivers 3 may be set in the desired manner. The supply rolls 5*a,* 5*b* and 5*c* may be driven by appropriate connecting gears from the respective motors 11*a,* 11*b* and 11*c*. It is, however, also feasible to provide the supply rolls 5*a,* 5*b* and 5*c* with their own, individual drive motors.

As shown in FIG. 3, the slivers 3*a–n* are guided by the upwardly open guide grooves between guide members 12*a–g*. Annular guide elements 53 are provided for the slivers 3 to guide the sliver from the respective coiler can to the first supply roll for that sliver.

FIG. 4*a* which illustrates the upper axial half of the supply roll 4*a,* shows that the supply rolls 4*a–c* have a hollow cylindrical cavity for accommodating the respective motor (such as a barrel motor) 11*a–c* therein. A stationary support member 14 laterally affixed to the intake table 2 serves as the housing flange for the stator stack 16 of the motor and further serves as the housing for the rotor 15 and as a supporting (bearing) stub shaft for the entire barrel motor. Coupling elements 17 between the stationary support member 14 and a support plate 18 are arranged at the end of the stator stack 16. The support plate 18 is attached to that end of the stator 16 which is remote from the stationary support member 14. At the end of the shaft 19 of the rotor 15 a carrier element (carrier plate) 20 is secured which is in engagement with the inner wall face 4'*a* of the supply roll 4*a*. Such a connection which serves to transmit the torque of the rotor 15 to the supply roll 4*a* may be frictional or form-fitting. In case the supply roll 4*a* is driven with small rpm's, a planetary gear is required. Bearings 21' and 21" support the shaft 19 on the inner face of the stationary member 14, while a bearing 21'" supports the supply roll 4*a* on the outer face of the stationary member 14. As shown in FIG. 4*b*, the supply roll 4*a*, the shaft 19 and the carrier element 20 rotate in the direction of the arrows B, C and D.

While the driving arrangement was described specifically in connection with the supply roll 4*a*, it is to be understood that all the other supply rolls of the apparatus may have an identical internal driving structure.

It is further to be understood that the invention also encompasses an embodiment where the rotor is located radially outwardly of the stator. In such a case the cylindrical outer surface of the rotor is attached directly to the cylindrical inner surface 4'*a* of the supply roll 4*a* or, in the alternative, the external rotor is designed as a hollow cylinder and, at the same time, constitutes the supply roll proper.

Turning to FIG. 5, for driving two coaxially arranged supply rolls, for example, supply rolls 4*a* and 5*a*, a single motor 11'*a* is provided which has a stator 16 and two rotors 15*a*, 15*b*. It is also feasible, as shown in FIG. 6, to provide a motor 11"*a* having a single stator and a single rotor for driving the two coaxially arranged supply rolls such as supply rolls 4*a* and 5*a*.

In FIG. 7 between the rpm-regulated drive motor 11*a* and the supply roll 4*a* a force transmission device is provided which includes two sprockets 51*a*, 51*b* and an interconnecting toothed belt 51*c*.

FIG. 8 shows a draw frame which may be an HSR model manufactured by Trützschler GmbH & Co. KG. The draw frame has a drawing unit 22 having an inlet 23 and an outlet 24. The slivers 3, after having passed the sliver guiding assembly described in connection with FIGS. 1–7, enter into a sliver guide 26 and, pulled by the withdrawing rolls 27 and 28, pass by a measuring member 29 incorporated in the sliver guide 26. The drawing unit 22 is a 4-over-3 drawing unit which has a lower output roll I, a lower middle roll II and a lower input roll III as well as four upper rolls 31, 32, 33 and 34 cooperating with respective lower rolls. The drafting of the plurality of slivers 3 (sliver bundle) is effected in the drawing unit 22. The drafting zone is composed of a preliminary and a principal drawing field. The roll pairs 34/III and 33/II form the preliminary drafting field whereas the roll pair 33/II and the roll assembly 31, 32/I form the principal drawing field. The drafted slivers 3 pass through a sliver guide 30 at the drawing unit outlet 24 and are pulled through a sliver trumpet 37 by cooperating withdrawing rolls 35 and 36. In the sliver trumpet 37 the slivers are combined into a sliver bundle 38 which is subsequently deposited into coiler cans as shown at 52 in FIG. 1.

The withdrawing roll pair formed of rolls 27, 28, the lower input roll III and the lower middle roll II which are mechanically coupled, for example, by toothed belts, are driven by an rpm-regulated motor 39 which rotates according to an inputted desired rpm magnitude. The respective upper to rolls 34 and 33 are driven by their respective lower rolls. The lower output roll I and the withdrawing roll pair formed of rolls 35 and 36 are driven by a principal motor 40. The regulating motor 39 and the principal motor 40 are associated with a respective regulator 41 and 42. The rpm regulation is effected by a closed regulating circuit in which the regulator 39 is associated with a tachogenerator 43 and the principal motor 40 is associated with a tachogenerator 44. At the input 23 of the drawing unit 22 a magnitude which is proportional to mass, for example, the cross section of the slivers 3, is measured by the measuring organ 29 which is described, for example, in German offenlegungsschrift (application published without examination) 44 04 326. At the outlet 24 of the drawing unit 22 the cross section of the exiting sliver 38 is sensed by a measuring organ 55 incorporated in the sliver trumpet 37 described, for example, in German Offenlegungsschrift 195 37 983. A central computer unit 46 (control and regulating device), for example, a microcomputer having a microprocessor, applies a desired setting value to the regulator 41 of the regulating motor 39. The measuring values of the two measuring organs 29 and 55 are applied to the central computer unit 46 during the drawing operation. The central computer unit 46 determines the desired value for the regulating motor 39 from the magnitudes of the measuring organ 29 and the desired value for the cross section of the exiting sliver 38. The measuring values of the measuring organ 55 serve for monitoring the exiting sliver 38. With the aid of the regulating system fluctuations in the cross section of the inputted slivers 3 may be compensated for by an appropriate regulation of the drawing operation and an evening of the outputted sliver 38 may be achieved by the measures according to the invention, according to which, as early as in the region of the intake table 2, undesired stretching of the slivers may be reduced or avoided. A memory 47 is connected with the central computer unit 46 of the draw frame to store for evaluation the signals of the control and regulating system. To the computer unit 46 there are furthermore connected a function transformer 49, for example, a peak transducer, a computer or the like which is electrically connected with the rpm-controlled electric motors 11*a*, 11*b*, 11*c*, 12*a*, 12*b* and 12*c*. Based on the preset desired values stored in the memory 47, the rpm of each electric motor 11*a*–11*c* and 12*a*–*c* is individually set. These electric motors are independently operated from the regulating motor 39 and the principal motor 40, that is, in particular, these electric motors are not coupled mechanically to the motors 39 and 40. Further, an inputting and retrieving unit 48 is connected to the central computer unit 46.

It is to be understood that by individual setting of the circumferential speed of each supply roll there is not meant a switch-off and switch-on of the drive, such as occurs, for example, in case of a sliver absence because of rupture or when a standby sliver is coupled in.

It will be understood that the above description of the present invention is susceptible to various modifications, changes and adaptations, and the same are intended to be comprehended within the meaning and range of equivalents of the appended claims.

What is claimed is:

1. A sliver supplying apparatus for simultaneously feeding a plurality of slivers from coiler cans to a draw frame operable by a draw frame drive; said apparatus comprising (a) an intake table;

(b) a plurality of supply rolls supported in a series by said intake table for guiding the slivers from the coiler cans to the draw frame;

(c) a plurality of idling rolls cooperating with respective said supply rolls for forming a plurality of rolls pairs arranged in a series on said intake table in a direction of said draw frame wherein the slivers pass between the supply roll and the idling roll of the roll pairs; and (d) rpm-setting means for individually setting a circumferential speed of said supply rolls to selectively set an intake tension of the individual slivers; said rpm-setting means including a roll drive independent from the draw frame drive.

2. The apparatus as defined in claim 1, wherein said rpm-setting means includes a plurality of roll drives; a separate said roll drive being connected to each said supply roll.

3. The apparatus as defined in claim 1, wherein said supply roll includes a hollow cylindrical roll body rotatably supported by said intake table and further wherein said roll drive is an electric motor accommodated inside said hollow cylindrical roll body; said electric motor having a shaft rotatably supported by said intake table and coupling means for torque-transmittingly connecting said shaft with said hollow cylindrical roll body.

4. The apparatus as defined in claim 1, wherein said supply roll includes a hollow cylindrical roll body rotatably supported by said intake table and further wherein said roll drive is an electric motor accommodated inside said hollow cylindrical roll body; said electric motor having a shaft rotatably supported by said intake table and a rotor constituted by said hollow cylindrical roll body.

5. The apparatus as defined in claim 1, further comprising a control and regulating apparatus; said roll drive being connected to said control and regulating apparatus for setting predetermined rpm's for said roll drive.

6. The apparatus as defined in claim 5, in combination with a draw frame supplied by slivers from said intake table; further comprising a measuring element located in said draw frame for detecting a property of the slivers running in the draw frame.

7. The apparatus as defined in claim 6, wherein said measuring element detects an extent of draw of the slivers.

8. The apparatus as defined in claim 1, further comprising two parallel emplacements underneath said intake table for receiving two series of parallel-extending coiler cans from which the slivers are withdrawn; further wherein said supply rolls are supported by said intake table in coaxially arranged roll pairs, wherein one supply roll of each roll pair supports slivers from cans situated on one of said emplacements and the other supply roll of each roll pair supports slivers from cans situated on the other of said emplacements.

9. The apparatus as defined in claim 8, wherein a separate single roll drive is connected to the two supply rolls of each said roll pair.

10. The apparatus as defined in claim 1, wherein said roll drive is an rpm-controlled electric motor.

11. The apparatus as defined in claim 10, wherein said electric motor is a servomotor.

12. The apparatus as defined in claim 11, wherein said servomotor is a d.c. motor.

13. The apparatus as defined in claim 11, wherein said servomotor is a frequency-controlled squirrel cage motor.

* * * * *